United States Patent [19]

Ford

[11] 3,991,435

[45] Nov. 16, 1976

[54] DECORATIVE TRAVERSE ROD

[75] Inventor: James A. Ford, Sherman Township, St. Joseph County, Mich.

[73] Assignee: Kirsch Company, Sturgis, Mich.

[22] Filed: Apr. 18, 1975

[21] Appl. No.: 569,214

[52] U.S. Cl. ..... 16/94 D; 160/345

[51] Int. Cl.[2] ..... A47H 1/04; A47H 5/00

[58] Field of Search ..... 16/94 D, 94 R, 95 R, 16/95 W; 160/19, 38, 39, 345, 346; 248/262

[56] References Cited

UNITED STATES PATENTS

| | | | |
|---|---|---|---|
| 2,501,133 | 3/1950 | Levy | 160/39 |
| 2,986,627 | 5/1961 | Marriett | 160/38 |
| 3,247,893 | 4/1966 | Ford | 16/94 D |
| 3,297,075 | 1/1967 | Howell et al. | 160/38 |

*Primary Examiner*—Werner H. Schroeder
*Assistant Examiner*—Conrad L. Berman
*Attorney, Agent, or Firm*—Woodhams, Blanchard and Flynn

[57] ABSTRACT

Traverse rod with decorative modular covering. There is provided a traverse rod having a basic rod structure of any of many conventional forms, together with a modular decorative facing, which latter is preferably of molded plastic material, the composite forming as a new product a traverse rod having the appearance of a carved wooden rod at a substantially less expense than that normal for such rods and further having the convenience, adaptibility and reliability of presently known metal rods. While the invention can be used with cut-to-measure traverse rods, it is primarily intended for and finds its greater utility with adjustable traverse rods. The facing material is formed in modular sections which are interlocked together end-to-end and fixed rigidly to the basic traverse rod for support thereon and rigidifying thereof. The operating features and support means are all those of the basic traverse rod.

15 Claims, 12 Drawing Figures

DECORATIVE TRAVERSE ROD

FIELD OF THE INVENTION

The invention relates to traverse rods and particularly to a type thereof primarily intended for adjustable traverse rods wherein a decorative modular facing of plastic or other moldable material is applied over and mounted in association with a basic conventional traverse rod. Although the invention is applicable to either cut-to-measure or adjustable traverse rods, it finds its greater utility and its primary inventive concept in its application to adjustable traverse rods.

BACKGROUND OF THE INVENTION

Traverse rods of both cut-to-measure and adjustable types have been known for a great many years and have been developed in a variety of specific forms. Many of such forms have, over the years, assumed a wide range of highly decorative forms and several such lines of decorative traverse rods are currently on the market. In all of these rods, however, the decorative aspect thereof was obtained only by appropriate shaping, and in some cases also coloring, of the rod structure itself. This requires expensive dies or other forming and shaping equipment and such decorative appearance is then not readily subject to modification or alteration. It is particularly not subject to such modifications as may be desired for meeting varying decorative motifs which may be adopted by individual customers.

I am aware that in at least one instance an elongated wooden covering made in a single piece has been placed over a cut-to-measure traverse rod and that same provides an attractive appearance and does combine the attractive appearance of a carved wooden pole with the advantages of a metallic traverse rod. However, such use is nothing more than a decorative covering for a traverse rod and provides no flexibility with respect to length of installation, no adaptability to various conditions of use and is extremely expensive.

Accordingly, the objects of the invention include:

1. To provide a decorative traverse rod having any desired external decorative appearance which can be operably associated with a metallic traverse rod of any of many substantially conventional designs.

2. To provide a decorative traverse rod having the general appearance of a carved wooden pole which is of much less cost than normal for such a pole, which is adjustable as to length within acceptably close limits and in which any of a number of inexpensively obtainable decorative patterns may be utilized as desired in a given installation.

3. To provide a decorative traverse rod as aforesaid wherein the particular decorative components may be changed from time-to-time as desired without altering or modifying the basic traverse rod and wherein such may be accomplished at an acceptably low level of expense.

4. To provide a decorative traverse rod as aforesaid wherein the decorative components may be molded from a plastics material and applied to the traverse rod in modules as needed to match the length thereof as required for a given installation.

5. To provide a decorative traverse rod as aforesaid wherein said modules are readily moldable from synthetic organic plastics material and same are designed for firm interlocking and rigid association with said traverse rod.

6. To provide a decorative traverse rod as aforesaid wherein the decorative units are easily applied by screw means, applied in one embodiment from the front of the traverse rod and in another embodiment from the rear thereof. In said one embodiment, said decorative units may be exchanged from time-to-time as desired during use but without dismounting or altering the basic traverse rod.

Other objects and purposes of the invention will become apparent to those familiar with devices of this general type upon reviewing the following specification and examining the accompanying drawings.

SUMMARY OF THE INVENTION

The invention contemplates the placement onto a substantially conventional metallic traverse rod, same being modified only as needed to receive fastening means, of a plurality of modularly formed facing units. Such facing units are made in any of many ways but preferably by molding synthetic organic plastics material and preferably with the provision of end-to-end interlocking means for holding said modular facing units firmly together. Further, it is desirable that the interlocking of the facing units be associated with means for fastening same to the traverse rod whereby a single such fastening means will function both to hold the modular units firmly in end-to-end abutting relationship to each other and appropriately on or with respect to the traverse rod.

While same can, if desired, be applied to cut-to-measure traverse rods, the invention finds its greater utility when used in connection with adjustable traverse rods. Such latter is then easily adjusted to the desired length and appropriately installed by the user, said length being chosen to fit the length of a selected plurality of said modular facing units. Reciprocally, said modular units, when properly fixed to the traverse rod, hold same rigidly at the selected length. Further, said control over the length of the otherwise adjustable traverse rod continues for the installation life of the traverse rod and at no time is any correction thereof required to such length. Any previously existing tendency with an adjustable traverse rod to creep in its length adjustment in response to the action of the sliders moving thereon, is entirely eliminated.

A secondary aspect of the invention relates to the detailed construction of the modular covering units and the specific means by which they are fastened to each other and fastened to a traverse rod. Such means as hereinafter disclosed involves appropriate interlocking of the ends of the traverse rod to hold same rigidly with respect to each other with a screw passing through the interlocking means and thence into the traverse rod so that when said screw is tightened both the interlocking means and the traverse rod all are held firmly together. This ensures an accurately fixed interrelation between adjacent modules of the facing means and the accurate and rigid interrelationship of such facing means with the traverse rod.

DETAILED DESCRIPTION

Figure 1:
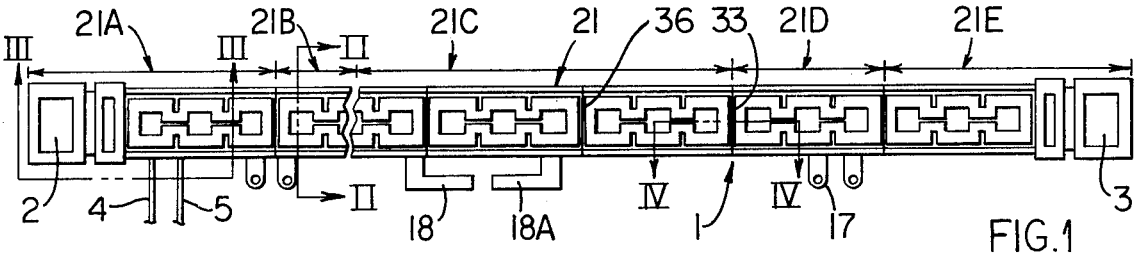
FIG. 1 is a broken front view of a traverse rod embodying the invention.
Figure 2:
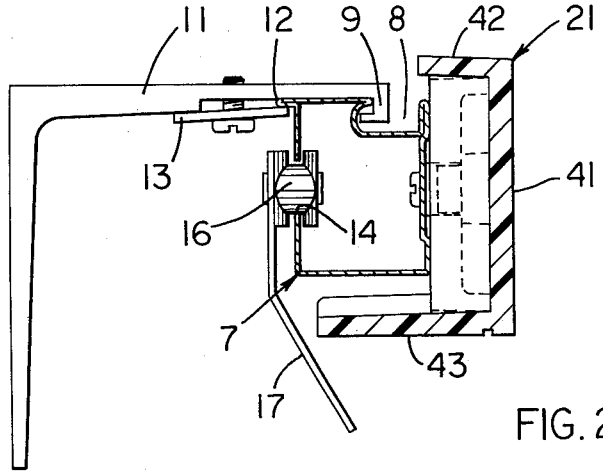
FIG. 2 is a section taken on the line II—II of FIG. 1.
Figure 3:
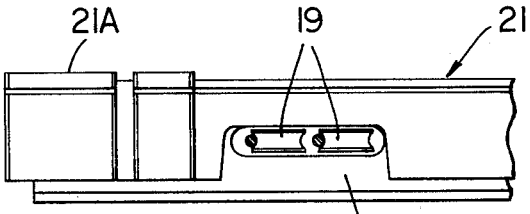
FIG. 3 is a portion of FIG. 1 as viewed from the bottom as indicated by the line III—III of FIG. 1.

Turning now to the drawings for an illustration of one specific traverse rod embodying the invention, there is shown in FIG. 1 a general front view of a traverse rod 1 having finials 2 and 3 and showing in this embodiment the conventional pull cords 4 and 5. The basic metallic traverse rod 7 (FIGS. 2–5), is, in this case, of generally conventional construction, rectangular in cross section, and has a groove 8 (FIG. 2) in its upward surface for the reception of the front hook 9 of a bracket 11 for mounting to a wall in the conventional manner. A rearwardly extending lip 12 on the traverse rod cooperates with a clip 13 for completing the gripping of the traverse rod on and by the bracket 11. This may be accomplished in any of several presently well-known ways, such as, for example, those shown in the U.S. Pat. to Ford, U.S. Pat. No. 3,247,893, or the presently pending application by James A. Ford, Ser. No. 442,378, entitled "Positively Supported Cam for Engaging a Traverse Rod," both said patent and said application being assigned to the same assignee as the present application. The traverse rod 7 is provided with a rearward slot 14 for the reception of sliders 16 from which depend hangers 17 and master carriers 18 and 18A (FIG. 1), all thereof being arranged in any conventional manner including the arrangements shown, for example, in U.S. Pat. Nos. 3,119,442, 3,503,434 and 3,522,621. The drapery is suspended from the hangers 17 in a conventional and known manner.

The traverse rod 7 is provided with known end pulleys 19 (FIG. 3) with which in this embodiment the pull cords 4 and 5 and master carriers 18 and 18A cooperate in any convenient conventional manner. Alternatively, if desired, the master hangers may be operated by a self-propelled linear motor means as disclosed and claimed in U.S. Pat. No. 3,374,823.

Figure 7:
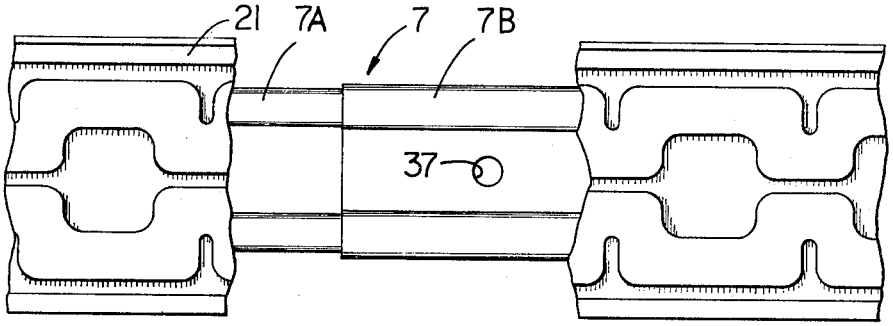
FIG. 7 is an enlarged, partially broken, fragment of the rod taken as a front view thereof showing same in the region of joining of the two components of an adjustable metallic basic rod.

Said traverse rod 7 comprises two portions 7A and 7B (FIG. 7) which are of similar cross section and telescope with respect to each other in a known manner for rendering said traverse rod of adjustable length.

Turning now the the facing means, same are indicated generally at 21 and comprise end-to-end connected modules of which several appear in FIG. 1 at 21A, 21B, 21C, 21D, and 21E. The end modules 21A and 21E may conveniently be, and are so shown in this embodiment, molded to include finials of any desired size and design. Said modules may be of varying selected lengths and it is entirely feasible, as indicated in FIG. 1, for one or more of the modules at each end, as the modules 21D and 21E (and corresponding modules at the other end of the rod) to be of length different from the remaining modules. By making the central modules, such as 21C, relatively long, such as 16 inches, and other modules, such as the module 21D and the corresponding module at the other end of the rod, relatively short, such as 4 inches, and by proper selection thereof, a sufficiently exact length can be obtained to fit most ordinary requirements and the adjustable rod may then be adjusted to conform to the total length of the end-to-end arranged modules so selected. In this embodiment each module, regardless of length, excepting the extreme end ones, has at one end a projection including a pilot 23 (FIG. 4) and at the other end a projection 27 including a lock opening 28. When two such modules are placed in end-to-end abutting relationship, one of said projections is off-set from the other in such a manner that same will overlap and respective pilots will fit snugly into said respectively adjacent openings so that with the parts so related the two modules will be fitted snugly together.

The two end modules 21A and 21E are provided with similar projections and pilots for one end set thereof and with similar projections and openings for the other end set thereof as required to fit the respectively adjacent ends of the modules 21B and 21D.

Figure 4:
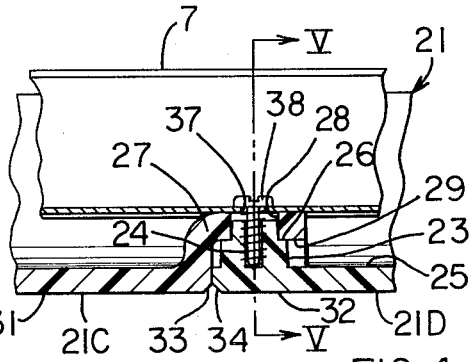
FIG. 4 is a section taken on the line IV—IV of FIG. 1.
Figure 5:
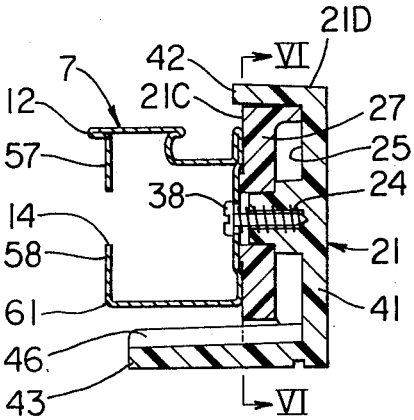
FIG. 5 is a section taken on the line V—V of FIG. 4.

While the interlocking means may be provided in any of many forms, one preferred arrangement is shown in FIG. 4 and comprises an inwardly directed pilot 23 projecting from the inner surface 25 at one end of a module, as the module 21D. Said pilot near its upper end is preferably provided with a portion of reduced diameter whereby to provide a step 26. The interlocking end of the adjacent module 21C is provided with the lip 27 having therein the lock opening 28. Said lock opening 28 is adapted to receive thereinto the reduced diameter portion of the pilot 23 whereby the outer surface 29 of said lip 27 contacts and bears against the inwardly directed step 26 of said pilot. The offset of the lip 27 is such that when said surface 29 and said step 26 are in contact as shown in FIG. 4, the outer surfaces 31 and 32 of said modules will be coplanar with respect to each other. If desired, and preferably, the respectively adjacent ends of said modules are also provided with beveled edges 33 and 34 which cooperate to form grooves similar to other grooves, such as the groove 36 (FIG. 1) separating sections of the design on a given module, whereby the visibility of any line of demarcation between said modules will be minimized and same appears to be merely a portion of the design of the entire composite traverse rod. A plurality of rod openings, of which one appears at 37, is provided along the basic traverse rod 7 and provide for the reception of a fastening screw 38 extending into the suitably threaded anchor opening 24 in the pilot 23 whereby to fasten firmly together said basic traverse rod 7 and the respectively interlocked portions of the abutting modules 21C and 21D. It will be recognized that said rod openings 37 will be spaced on centers whose multiple will equal the length of said modules whereby said rod 7 may be adjusted in length as desired to equal a length selected by appropriate selection of facing unit modules. Thus, when so arranged, the rod openings 37 of the basic traverse rod 7 will be in register with the interlocking means of the several respectively abutting ends of the several facing unit modules. As a specific example, where central modules, as the module 21C, is 16 inches in length, and an end module as the module 21D is 4 inches in length, the spacing between the openings 37 will advantageously be 4 inches.

Turning now to the structure of the modules themselves, same may be of any shape effective for effectively concealing the basic traverse rod 7 from normal view from within the room when said modules are mounted on the front of the traverse rod. It has been found effective in most instances to construct said modules with a somewhat modified C-shaped cross section, namely a cross section having a front panel 41 (FIGS. 2 and 5), an upper flange 42 and a lower flange 43, said C-section being arranged to generally embrace the basic rod. Said front panel 41 will be of sufficient vertical height to overlap at both top and bottom the corresponding height of the basic traverse rod 7. The top flange 42 extends from the vertical panel 41 toward and over the basic traverse rod, with or without touching the upper surface thereof, but will terminate as required to permit access by the bracket 11 to the means on the rod provided for engaging therewith. In this embodiment, the flange 42 terminates at such a point as to permit access to the groove 8 by the hook 9 of the bracket 11.

The bottom flange 43 of said module extends inwardly from the lower edge of the vertical panel 41 and under the basic rod structure, with or without touching the lower surface thereof, a sufficient distance as to effectively conceal the basic traverse rod 7 from normal view from within the room. It has been found satisfactory and as illustrated in the present embodiment for said flange 43 to extend most of the distance to, though not necessarily all of the way to, a point coplanar with the rear surface of the basic traverse rod 7. However, appropriate cut-outs are provided in the flange 43 for passage of the pull cords 4 and 5.

As already indicated, any desired decorative design may be applied to the front panel 41 and, if desired, also to either or both of the flanges 42 and 43.

Figure 6:
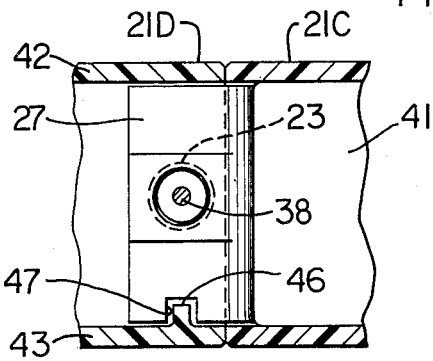
FIG. 6 is a section taken on the line VI—VI of FIG. 5.

For still more firm holding of the modules to and with respect to each other, there may also be provided, near the end of each module having the pilot 23, an upstanding ridge 46 (FIG. 6). Said ridge is received into an appropriate groove 47 in the adjacent portion of the lip 27. Further, said lip 27 is made of such vertical dimension as to fit snugly between the flanges 42 and 43 whereby further to inhibit relative motion between abutting and connected modules.

In assembly, the modules are interlocked together with the pilot 23 extending into the opening 28 and the screw 38, such as a common sheet metal screw, is fitted into the appropriate one of the incrementally spaced openings 37 in the basic rod 7 and screwed into the pilot 23. Thus, the modules are firmly locked to each other and to the basic rod 7 and where said latter is adjustable, same is firmly and rigidly held in a selected adjusted position.

While not an essential part of the invention, it will be found extremely helpful in installation if there is utilized in connection with the driving of the screws 38 a guide and protecting device 51 (FIGS. 9–12). Such guide comprises a body member 52 having therein an opening 53 through which a screw driver may extend to reach a screw 38. The flanges 54 and 56 of said device overlap the flanges 57 and 58 of the basic traverse rod 7 and protect same from being bent or battered by the screw driver. A stabilizing and locating arm 59 may also be provided to extend around the corner 61 of the traverse rod to rest against the flange 43 whereby to stabilize said guide member 51. Preferably the ridge 46 will be in a predetermined relationship, as direct alignment, with the pilot hole 24 and accordingly the arm 59 is preferably provided with a notch 60 to straddle the ridge 46 and thus assist in locating the guide 51 in proper alignment with the lock opening 28 and screw hole 24.

It will thus be recognized that by combining rigid but incrementally selectable modules for the decorative facing portion of the composite rod product with a slidably adjustable basic traverse rod having appropriate hanger supporting and operating means, such basic traverse rod will function as the supporting means for the decorative modules while said modules themselves function to rigidify the adjustable rod in a selected adjusted position. Thus, there is formed as a resultant product a decorative functional and rigid traverse rod ready for mounting and for use in an otherwise conventional manner.

In the form of the invention shown in FIGS. 1–6, it will be noted that the fastening screws 38 extend from the inside of the traverse rod into the pilots 23 of the facing modules. This enables the screws to be completely hidden from the room side of the traverse rod so that by appropriately including the line formed by the abutting end surfaces of the modular units properly into the decorative pattern thereon, the modular nature of the facing units will be substantially unnoticeable from the room side of the traverse rod and the appearance will be that of a solid decorative pole-type unit. This provides a highly attractive end product but requires that the assembly be completed before the rod is placed into position and further requires that the rod be demounted in its entirety if the facing units are to be replaced, such as in association with a change in the decorative motif of the room in which the rods are used.

Figure 8:
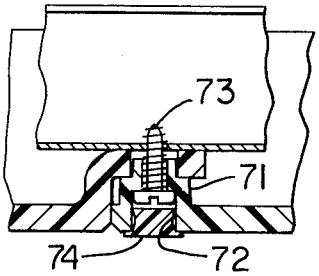
FIG. 8 is a fragmentary sectional view corresponding to FIG. 4 and showing a modification.
Figure 9:
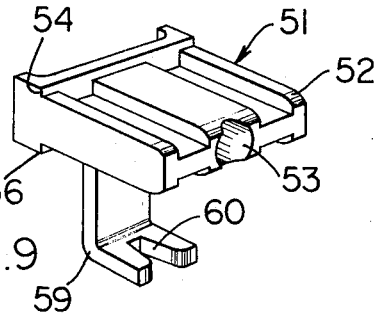
FIG. 9 is an oblique view of a screw locating and guide means.
Figure 10:
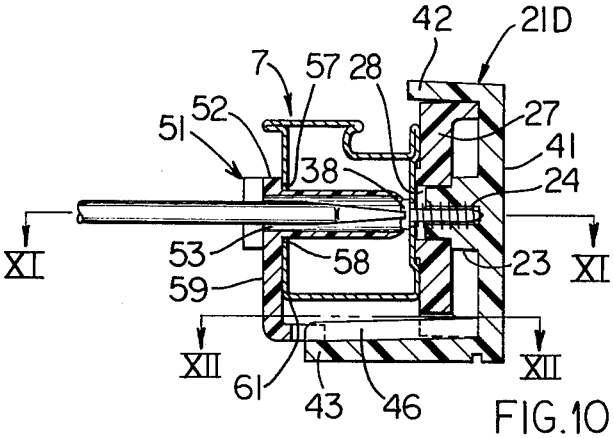
FIG. 10 is a view similar to FIG. 5 showing the screw guide means in operative position.
Figure 12:
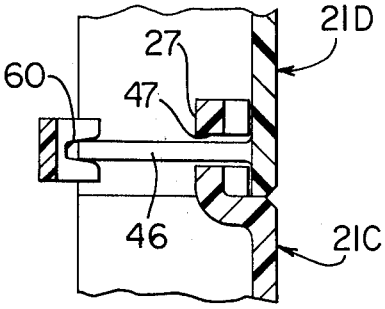
FIG. 12 is a section taken on the line XII—XII of FIG. 10.
Figure 11:
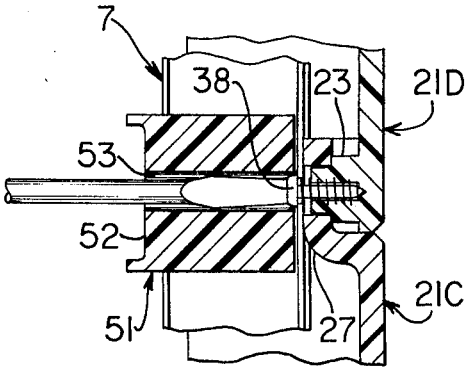
FIG. 11 is a sectional view taken on the line XI—XI of FIG. 10.

In the embodiment shown in FIG. 8, the pilot 71 is provided with an opening 72 through which the screw 73 may pass and such screw extends therethrough from the outward side of the facing unit into a suitable opening in the traverse rod by which again the facing units and the rod may be firmly interlocked together. If desired, a suitable plug 74 may be provided for concealing the screw from external view. The externally observable circle defined by the plug 74 may, if desired, be incorporated into the decorative motif of the facing units so that its presence will not be objectionable.

It will be recognized that with this last-named construction, if and when desired, the motif of the decoration may be changed by removing and replacing the modular decorative cover members and that such may be accomplished from the front of the rod without demounting of same merely by removal of the screws 73 and the replacement and fastening of substitute decorative modules by the same or similar screws. Thus, the appearance of the rods may be readily altered as desired to follow changes in the decoration of a given room or to follow, for example, seasonal changes in the desired appearance of the traverse rods.

While screws have been assumed in both of the described embodiments to be the fastening means employed, and such are highly effective and reasonably convenient, it will be recognized that at least the broader aspects of the invention may contemplate a wide range of other specific fastening devices, such as double-faced tape, nails, clips, snaps (plastic or metal) or rivets.

While the decorative modules have above been assumed to be of injection molded plastics construction, other constructional methods and materials, such as carved wood or cast metal, will be acceptable if and to the extent that same can be justified on cost, appearance or other relevant bases.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A decorative traverse rod assembly for supporting curtain means, such as draperies, comprising:

a hollow, slotted elongated traverse rod, a plurality of draper hangers slidably supported on said rod, and operator responsive means connected to at least one of said hangers for effecting longitudinal sliding of said hangers as required to effect normal opening and closing movement of such draperies;

a plurality of modular facing means, each thereof being of selected modular length and each being fixedly supported on said traverse rod and positioned in serially arranged relationship thereon for providing a decorative covering for said traverse rod and thereby providing an operable and decorative composite traverse rod unit;

each of said facing means being generally C-shaped in cross-section and positioned on said traverse rod to partially embrace same, said C-shaped section having an upper flange extending at least partially over an upper side of said traverse rod and a lower flange extending at least partially under a lower side of said traverse rod;

one of a pair of end-to-end abutted facing means including a lip projecting between and fitting snugly against said flanges of the other of said pair, and fastening means fixing said pair rigidly together; and mounting means for mounting said composite rod unit to a supporting surface.

2. The device of claim 1 wherein said fastening means also fixes said modular facing means rigidly to said traverse rod.

3. The device of claim 1 including an opening in said lip, a pilot projecting from the adjacent surface of said other facing means and extending through said opening, said lip and said pilot being interrelated to position the outer surfaces of said facing means coplanar with respect to each other when same are firmly interlocked with respect to each other.

4. A decorative traverse rod assembly for supporting curtain means, such as draperies, comprising:

a hollow slotted traverse rod, a plurality of hangers slidably supported on said rod, said hangers being adapted to have said curtain means attached thereto, and operator responsive means interconnected to at least one of said hangers for effecting slidable movement of said hangers longitudinally of said rod to effect normal opening and closing movement of said curtain means;

bracket means connected directly to said traverse rod for mounting said traverse rod to a supporting surface, such as a wall;

elongated decorative facing means fixed to said rod and extending longitudinally thereof for providing a decorative covering for said rod, said facing means including a plurality of decorative facing members which are of selected modular lengths and are each supported on said traverse rod, said plurality of facing members being positioned in serially arranged relationship on said rod for providing said decorative covering, whereby said facing means and said rod define an operable and decorative composite traverse rod unit; and connecting means for releasably fixedly securing said facing means directly to said rod.

5. An assembly according to claim 4, wherein said connecting means cooperates between said rod and each said facing member for individually fixedly connecting each said facing member directly to said rod.

6. A rod assembly according to claim 4, including interfitting means coacting between adjacent facing members for preventing separation between said adjacent facing members in the longitudinal direction of said rod, said interfitting means permitting said adjacent facing members to be separated only by relative movement therebetween in a direction transverse to the longitudinal direction of said rod.

7. An assembly according to claim 4, wherein said traverse rod is longitudinally adjustable and includes a pair of elongated rod sections which are slidably telescoped one within the other, and said connecting means fixedly connecting said facing means to each of said rod sections for rigidly holding said traverse rod in a selected adjusted position.

8. An assembly according to claim 4, wherein each said facing member includes a front wall portion which overlaps the front wall of said rod, each said facing member also including an inwardly projecting lower flange fixed to the lower edge of said front wall portion and projecting inwardly beneath said rod so as to at least partially overlap same.

9. An assembly according to claim 4, wherein each pair of adjacent facing members have the adjacent ends these of disposed in abutting engagement so that said plurality of serially arranged members appear as a single elongated member, and wherein said connecting means includes a plurality of removable connecting elements, at least one of said connecting elements being associated with each of said facing members for fixedly directly attaching each said facing member to said rod, said connecting elements being removable to permit the facing members to be individually removed from said rod.

10. An assembly according to claim 9, wherein said removable connecting elements are accessible when said composite rod unit is mounted on said supporting surface so as to permit said facing members to be removed from said rod while permitting said rod to remain mounted on said supporting surface.

11. A decorative traverse rod assembly for supporting curtain means, such as draperies or the like, comprising:

a slotted elongated traverse rod having a plurality of hanger means slidably supported thereon, said hanger means being adapted to have said curtain means attached thereto, and operator means connected to at least one of said hanger means for effecting longitudinal movement of said hanger means along said rod as required to effect normal opening and closing movement of said curtain means;

an elongated facing means positioned adjacent to and extending longitudinally of said rod for covering the front face of said rod to provide a decorative covering therefore, said facing means including a plurality of decorative modular facing members positioned in aligned and serially arranged relationship along said rod so as to cover the front face of said rod throughout the complete length thereof, the adjacent pairs of said facing members having their adjacent ends disposed in abutting engagement;

connecting means coacting between said rod and said facing means for releasably fixedly connecting same together to form a composite rod unit, said connecting means includes means for direcly and individually connecting each said facing member to said rod; and mounting means for mounting said composite rod unit to a supporting surface, such as a wall.

12. A rod assembly according to claim 11, wherein each said facing member includes a front wall portion which overlaps the front wall of said rod, each said facing member also including an inwardly projecting lower flange fixed to the lower edge of said front wall portion and projecting inwardly beneath said rod so as to at least partially overlap same.

13. A rod assembly according to claim 11, wherein said facing members are of a generally C-shaped cross-section and are positioned so as to partially surround said rod.

14. A rod assembly according to claim 11, including means coacting between the adjacent ends of said facing members for preventing relative sideward displacement between the adjacent facing members when they are disposed in aligned relationship and have the adjacent ends abutted together, said means including a recess formed in one end of each said facing member except for the endmost members and a lip projecting outwardly from the other end of each said facing member except for the endmost members whereby the lip on one member is slidably received within the recess in the adjacent member for positively preventing relative sideward displacement therebetween.

15. A rod assembly according to claim 14, wherein said connecting means includes a connecting member extending between the adjacent ends of each pair of adjacent facing members for fixedly connecting same together, said connecting member also being fixedly connected to said rod to thereby fixedly connect said facing members to said rod.

* * * * *